United States Patent [19]

Albertson

[11] 4,276,914

[45] Jul. 7, 1981

[54] CLEANING APPARATUS AND METHOD

[76] Inventor: Robert V. Albertson, 2100 Shadywood Rd., Wayzata, Minn. 55391

[21] Appl. No.: 908,273

[22] Filed: May 22, 1978

[51] Int. Cl.[3] ..... B65B 3/12; B08B 9/00

[52] U.S. Cl. ..... 141/92; 123/41.42; 134/169 A; 417/403

[58] Field of Search ..... 123/41.42, 41.44; 134/100–102, 169 R, 169 A, 171; 137/237, 239; 141/1, 85, 89, 91, 392, 92; 417/401, 403, 404

[56] References Cited

U.S. PATENT DOCUMENTS

| | | | |
|---|---|---|---|
| 182,387 | 9/1876 | Shortt | 417/401 |
| 807,448 | 12/1905 | Farnsworth | 91/342 |
| 1,853,767 | 4/1932 | Kent | 417/402 |
| 1,993,230 | 3/1935 | Taylor | 230/50 |
| 2,018,215 | 10/1935 | Lausen | 103/46 |
| 2,222,516 | 11/1940 | Powell et al. | 141/1 |
| 2,380,604 | 4/1942 | Melton | 141/1 |
| 2,537,215 | 1/1951 | Dunn | 134/169 |
| 2,780,171 | 2/1957 | Heddy | 103/5 |
| 2,835,234 | 5/1958 | Rasch et al. | 123/41.42 |
| 3,094,131 | 6/1963 | Williams | 134/98 |
| 3,188,006 | 6/1965 | Falk | 237/8 |
| 3,321,977 | 5/1967 | Topham | 73/422 |
| 3,374,746 | 3/1968 | Chenault | 103/46 |
| 3,434,490 | 3/1969 | Lyall | 137/101.31 |
| 3,667,487 | 6/1972 | Schoenbeck et al. | 134/108 |
| 3,667,488 | 6/1972 | Paggen | 134/169 |
| 3,780,757 | 12/1973 | Jordan | 137/205 |
| 3,963,383 | 6/1976 | Hill | 417/401 |
| 4,054,150 | 10/1977 | Thomas | 134/169 |

OTHER PUBLICATIONS

"The Care and Feeding of Your Cooling System", *Motor Trend,* May 1977, Vol. 29, No. 5, pp. 82–87.

*Primary Examiner*—Frederick R. Schmidt
*Attorney, Agent, or Firm*—Burd, Bartz & Gutenkauf

[57] ABSTRACT

A portable air-operated apparatus for cleaning, flushing, and filling a liquid cooling system of an internal combustion engine. The apparatus has an air-operated reciprocating piston pump assembly operable to agitate or sequentially move liquid in opposite directions and pump liquid into the cooling system. The pump assembly delivers the liquid to a manifold connected to an input hose coupled to the liquid cooling system. A control valve connected to the manifold is operable to direct an external source of liquid under pressure to the manifold or connect a reservoir carried by the apparatus to the manifold. The manifold has a check valve for controlling one-way forward flow of liquid from the pump to the input hose. A by-pass hose connects the control valve and manifold to by-pass the check valve to allow reverse flow of liquid in the input hose back to the pump assembly so that the pump assembly will effect a sequential forward and reverse flow of liquid in the cooling system. The control valve is operable to connect the reservoir to the manifold so that the cooling system can be filled by the operation of the pump assembly with liquid stored in the reservoir. A filter located in the reservoir filters liquid moved from the reservoir by the pump assembly to the cooling system.

56 Claims, 14 Drawing Figures

FIG. 6
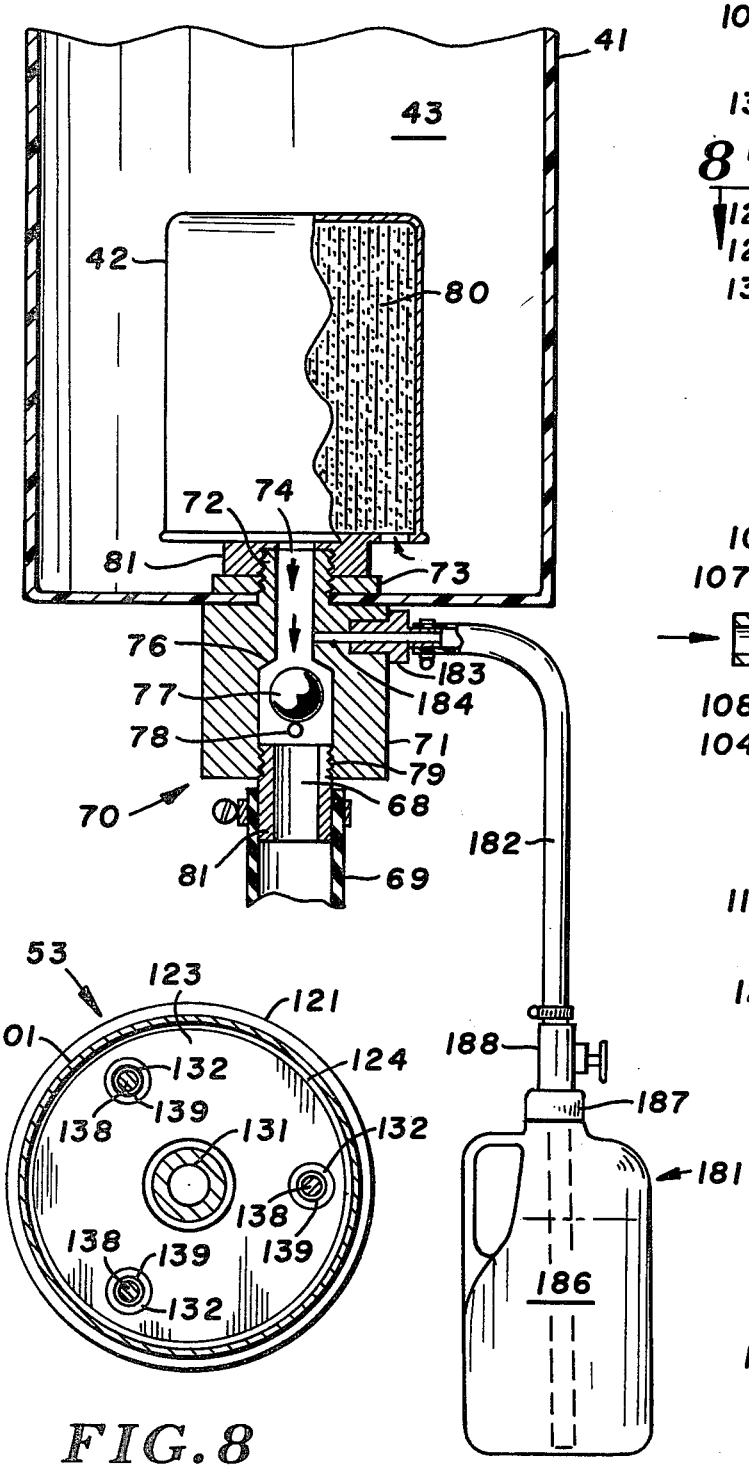
FIG. 8
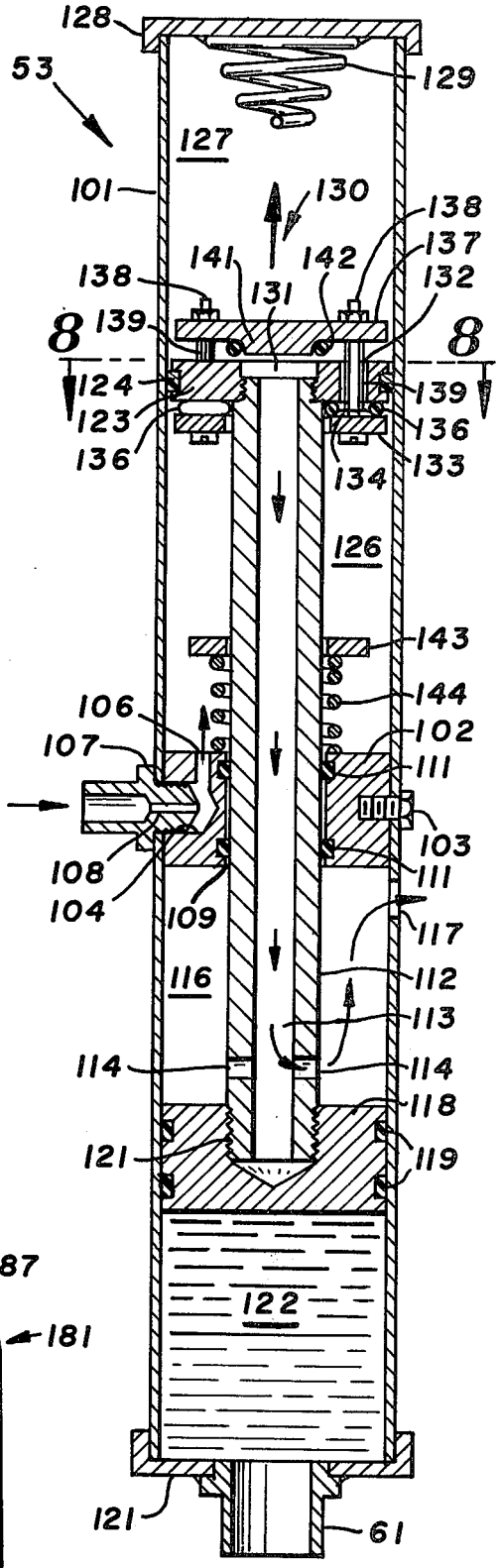
FIG. 7

CLEANING APPARATUS AND METHOD

BACKGROUND OF INVENTION

The invention is directed to an apparatus for cleaning and filling a liquid containing means, such as a cooling system of an internal combustion engine. It is a conventional and necessary practice to clean and flush radiators, heater cores, and blocks of internal combustion engines to remove foreign matter, as scale, sludge, dirt, and deposits, that accumulate therein. The usual flushing procedure is to use a garden hose to pass a continuous stream of water through the radiator and motor block. Chemical additives have been employed to facilitate the dissolving of the foreign matter in the cooling system. The chemical additives are not effective when the cooling system is plugged or stopped, as the chemicals do not flow to the desired location in the cooling system.

Cleaning machines employing electrically driven pumps have been used to provide a supply of cleaning fluid under pressure to the radiator, heater, and engine blocks of an internal combustion engine. The pumps operate to provide a continuous supply of liquid to effect a reverse flushing of the engine cooling system. Some machines are portable cabinet structures that can be moved around the work area. The power source for the machines includes an electric motor adapted to be connected with an electric cord to the conventional 110 power outlet. The electric cords, connections, and electric motors can develop shorts as they are used in a wet environment commonly found in a garage or automobile work area. Cleaning machines have been developed which employ a 12-volt electric motor used to drive a pump for delivering the cleaning liquid to the cooling system. The battery of the vehicle is used as a power supply for the electric motor.

The current automobile engines are equipped with smaller capacity cooling systems to reduce the weight. These cooling systems are operated under higher temperatures and pressures to increase cooling rate and efficiency. These systems must be periodically cleaned to insure sufficient heat transfer and liquid circulation. The apparatus of the invention is a portable air-operated machine useable to clean and fill the cooling system of an internal combustion engine.

SUMMARY OF INVENTION

The invention is a new and improved apparatus and method for delivering a liquid to a liquid accommodating means or desired location and agitate or move the liquid in sequential forward and reverse directions to effect a reversing surge cleaning action.

The apparatus is also used to fill the liquid accommodating means with a desired liquid, check the liquid accommodating means for leaks and weak connections, and flush the liquid and foreign matter carried by the liquid out of the liquid accommodating means. The liquid accommodating means can be the cooling system of an internal combustion engine.

The apparatus includes a portable housing providing the apparatus with convenient mobility and utility in remote locations. The apparatus has an air-operated pump assembly. An electric power source is not used to operate the pump assembly, thus eliminating electrical shock hazards. The apparatus is adapted to receive a source of liquid under pressure, such as water, and direct the water to the liquid accommodating means. A suitable water hose delivers the outside water to a control valve that is selectively operable to fill the liquid accommodating means, as a liquid cooling system, with water. The pump assembly has a reciprocating pump piston located in a cylinder connected to means responsive to air pressure to reciprocate the pump piston in the cylinder thereby sequentially moving the liquid in forward and reverse directions. The piston assembly includes an air drive piston carrying a shuttle valve mechanism operable to sequentially apply air under pressure to opposite sides of the drive piston thereby reciprocating the pump piston. The pump assembly delivers the liquid to a manifold having a check valve for controlling one-way flow of liquid to an input hose connected to the liquid cooling system. A liquid by-pass hose connects the valve assembly with the manifold to allow liquid to by-pass the check valve during the reverse or back flow of liquid toward the pump assembly. A housing is provided with a reservoir for holding liquid to be pumped into the cooling system. The reservoir has an outlet containing a check valve allowing one-way flow of liquid out of the reservoir into the control valve in response to operation of the pump piston. A liquid filter unit located in the reservoir is connected to the outlet to filter the liquid before it flows through the outlet into the control valve. The pump assembly operates to draw liquid out of the reservoir into the cooling system via the manifold and input hose.

The apparatus is provided with a pressure gauge connected with a line to the manifold. The pressure gauge is used to monitor the leak integrity of the cooling system.

The input hose carries the forward and reverse moving fluid to the heater hose of a cooling system of an internal combustion engine. A tee interposed in the inlet heater hose is connected to the input hose. The tee can have one or more control valves which are operable to direct all of the liquid to the heater, to the engine block, or simultaneously to both the heater and engine block.

IN THE DRAWINGS

FIG. 6 is an enlarged sectional view taken along line 6—6 of FIG. 3;

FIG. 7 is a sectional view taken along line 7—7 of FIG. 3;

FIG. 8 is a sectional view taken along line 8—8 of FIG. 7;

DESCRIPTION OF PREFERRED EMBODIMENT

Figure 1:
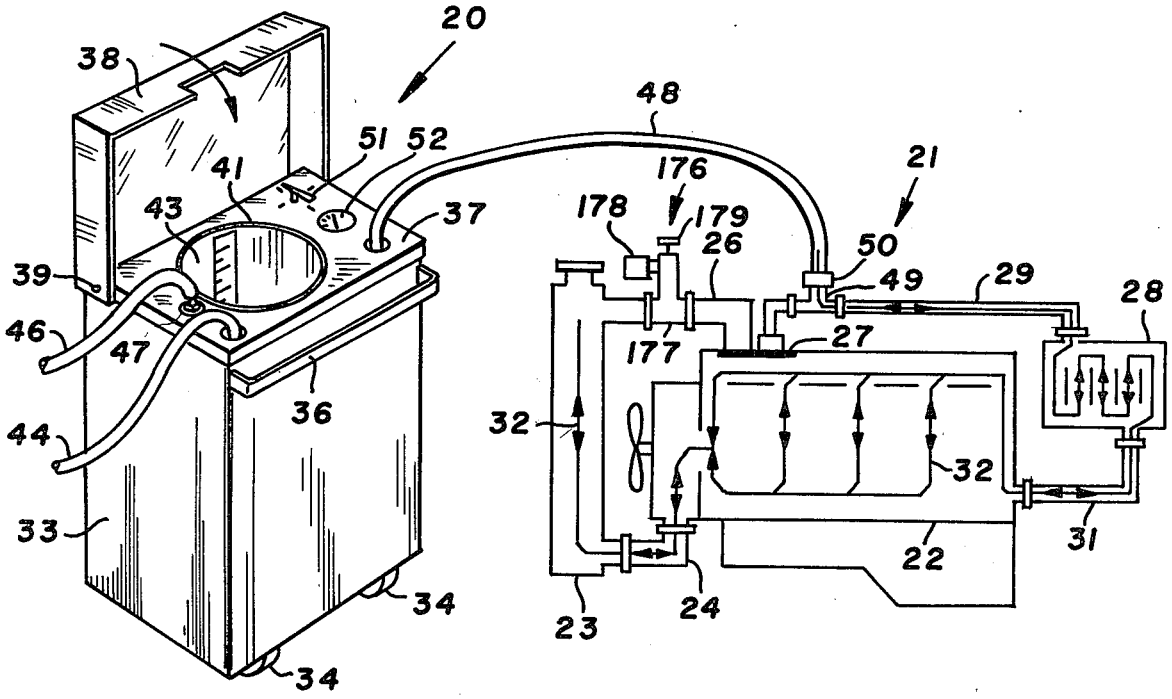
FIG. 1 is a perspective view of the apparatus of the invention associated with a cooling system of an internal combustion engine.
Figure 2:
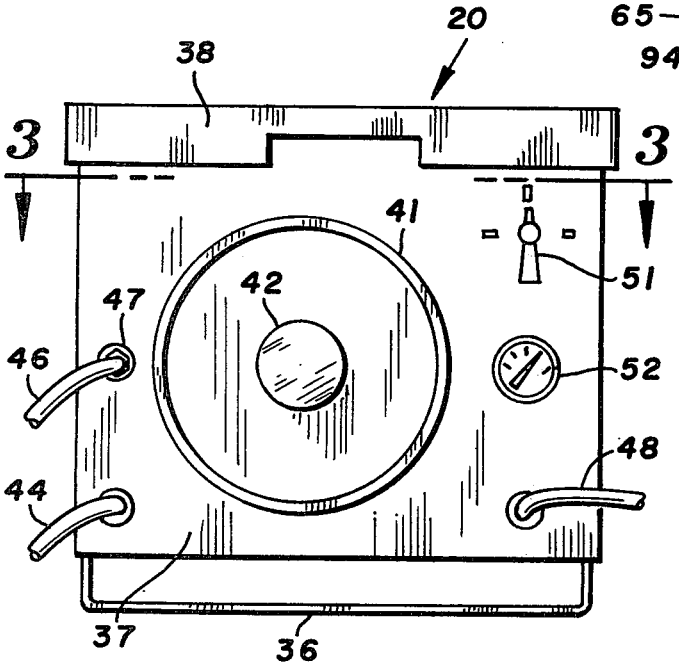
FIG. 2 is a top view of the apparatus of FIG. 1.

Referring to FIG. 1, there is shown an apparatus indicated generally at 20 for delivering a cleaning liquid to a liquid accommodating or containing means illustrated as a liquid cooling system of an internal combustion engine 21. The liquid containing means can be structures other than engine cooling systems. For example, apparatus 20 can be used to clean and flush heating and cooling systems, distillation towers, boilers, water softeners, heat exchange units, cooling jackets of plastic molding machines, and the like. Apparatus 20 is hereinafter described with a liquid cooling system of a conventional internal combustion engine.

Apparatus 20 is operable to agitate, flush the engine cooling system of foreign material, as rust, scale, sludge, and the like, monitor the system for leaks, and fill the system with clean cooling liquid. The internal combustion engine 21 is a conventional engine of an automobile, truck, bus, tractor, and the like. Engine 21 is shown in diagrammatic form as having an engine block 22 coupled to a radiator 23 with a lower radiator hose 24 and an upper radiator hose 26. Upper radiator hose 26 is coupled to block 22 adjacent a thermostat 27. The cooling system includes a heater core 28 connected to block 22 with an inlet heater hose 29 and an outlet heater hose 31. The cleaning liquid in the cooling system of the internal combustion engine is agitated or moved back and forth as indicated by the double arrows 32 by operation of apparatus 20, as hereinafter described.

Apparatus 20 has a box-shaped upright housing 33 movably supported on a surface, as a floor, with a plurality of rollers or caster wheels 34. An elongated horizontal handle 36 is attached to the upper part of the front of housing 33 to facilitate hand movement of apparatus 20. The top of housing 33 has a flat top wall or plate 37 and a box-shaped cover 38. Bolts 39 pivotally connect opposite sides of cover 38 to the rear upper portions of housing 33 allowing cover 38 to be pivoted to a forward horizontal closed position covering top plate 37. When cover 38 is in the open position, as shown in FIG. 1, it is located in an over-center upright rearward location so that it stays open.

The center of top plate 37 has a hole accommodating a pail or reservoir 41. A liquid filtering cartridge or unit 42 is mounted on the bottom of reservoir 41. Reservoir 41 has an open top chamber 43 for accommodating a liquid, as anti-freeze. Cartridge 42 can be a conventional oil filter unit operable to filter liquid in reservoir 41 as it flows to a pump circuit of apparatus 20.

An external supply of liquid, as water, is delivered to apparatus 20 through a hose 44. An air line 46 releasably attached to a connector 47 mounted on top plate 37 functions to supply air under pressure to apparatus 20. The air pressure can vary between 90 or 125 or more psi. Hose 44 and air line 46 can have considerable length so that the apparatus 20 can be removed to a remote location. Apparatus 20 does not need an electrical supply to function. Accordingly, there is no danger of electrical shock in the operation of apparatus 20. A liquid input hose 48 connects apparatus 20 with a tee or coupling 49. Tee 49 is interposed in inlet heater hose 29 whereby apparatus 20 delivers liquid under pressure via hose 44 to the cooling system of the internal combustion engine.

Figure 3:
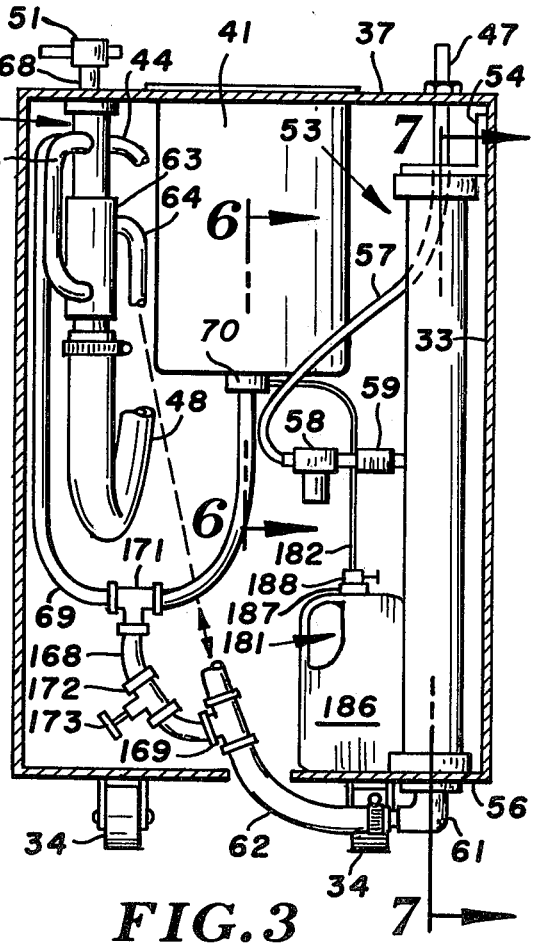
FIG. 3 is a sectional view taken along line 3—3 of FIG. 2.

Referring to FIG. 3, there is shown the means for pumping liquid in forward and reverse directions to and from input hose 48. The forward and reverse movement of the liquid establishes reversing surge cleaning action or liquid agitation in the cooling system. The agitation of the liquid in the cooling system causes the foreign matter, as dirt, scale, sludge, and the like, in the cooling system to break up and become suspended or dissolve in the liquid. The foreign matter can then be readily flushed from the cooling system.

An upright pump apparatus or assembly indicated generally at 53 is located under top plate 37 adjacent one side of housing 33. The upper end of pump apparatus 53 is mounted on a bracket 54. The bottom of the pump apparatus 53 is attached to the bottom wall 56 of housing 33. Other types of structures can be used to mount pump apparatus 53 on housing 33. Pump apparatus 53 is connected to air supply line 46 with an air line 57 leading from connector 47 to a pressure regulator 58. Regulator 58 is set to control the speed of operation or pumping cycle of pump apparatus 53. Preferably, pump apparatus 53 operates at about 20 strokes per minute. Other pumping cycles can be used. A connector 59 connects regulator 58 with the midsection of pump apparatus 53. The structure and operation of pump apparatus 53 is hereinafter described with reference to FIGS. 7–12.

Figure 5:
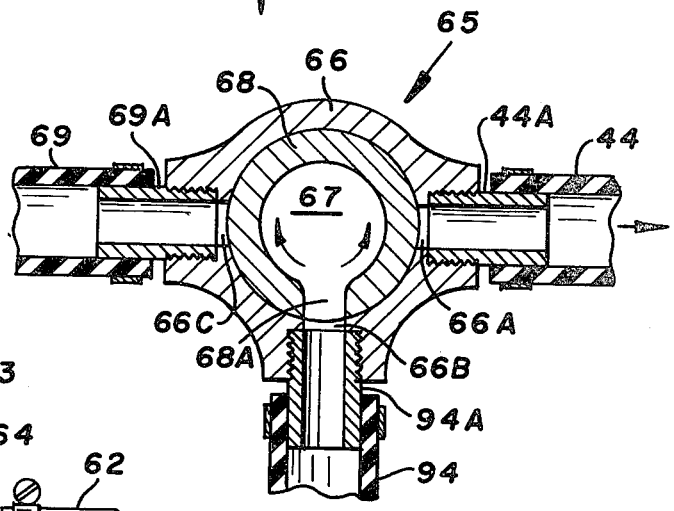
FIG. 5 is an enlarged sectional view taken along line 5—5 of FIG. 4.

An elbow or outlet connector 61 is attached to lower end of pump apparatus 53. Connector 61 is coupled to a pump hose 62 which leads to a manifold 63. An elbow 64 joins the upper ends of hose 62 to manifold 63. A four-way control valve 65 is attached to the upper end of manifold 63. As shown in FIG. 5, valve 65 has a casing or body 66 provided with an upright passage 67 open to manifold 63, and three side ports 66A, 66B, and 66C. Water hose 44 connected to a connector 44A threaded into port 66A carries water to passage 67. A rotatable tubular cylinder 68 having a side port 68A is located in passage 67 to control the flow of liquid in passage 67 from ports 66A, 66B, and 66C. Port 66B is in communication with a by-pass hose 94 mounted on nipple 94A. Port 66C is in communication with reservoir hose 69 mounted on nipple 69A. Cylinder 68 is connected to valve control lever 51 used to manually rotate cylinder 68 in opposite directions as shown by the arrows in FIG. 5 aligning port 68A with either ports 66A, 66B, or 66C.

A reservoir hose 69 connects the upper part of manifold 63 to a check valve 70 secured to the center of the bottom of reservoir 41. Referring to FIG. 6, check valve 70 has a body 71 having an upwardly directed threaded nipple 72 extended through a center hole in the bottom of reservoir 41. A nut 73 clamps body 71 to the bottom of reservoir 41. Body 71 has an upright passage 74. The lower portion of passage 74 is enlarged forming a shoulder or seat 76. A check ball or valving member 77 located in the large portion of passage 74 is adapted to engage shoulder 76 to close passage 74 preventing liquid from flowing from hose 69 into reservoir 41. A pin 78 secured to body 71 below ball 77 retains the ball in passage 74 below seat 76. The lower portion of passage 74 has threads 79 to accommmodate the threaded end of reservoir hose 69. Filter unit or cartridge 42 has liquid filtering media or material 80, as paper, cotton, and the like, and bottom threaded sleeve 81 adapted to be threaded on nipple 72. Filter unit 42 can be removed from reservoir 41 by turning the unit to release the threaded connection between sleeve 81 and nipple 72. The liquid in reservoir chamber 43 flows through the filtering material 80 in filter unit 42 before it flows downwardly through passage 74. Ball 77 prevents the liquid in reservoir hose 69 from flowing back through filter unit 42 into chamber 43. Filter unit 42 is the conventional oil filtering cartridge used as a replaceable element in an oil filter of an internal combustion engine.

Figure 4:
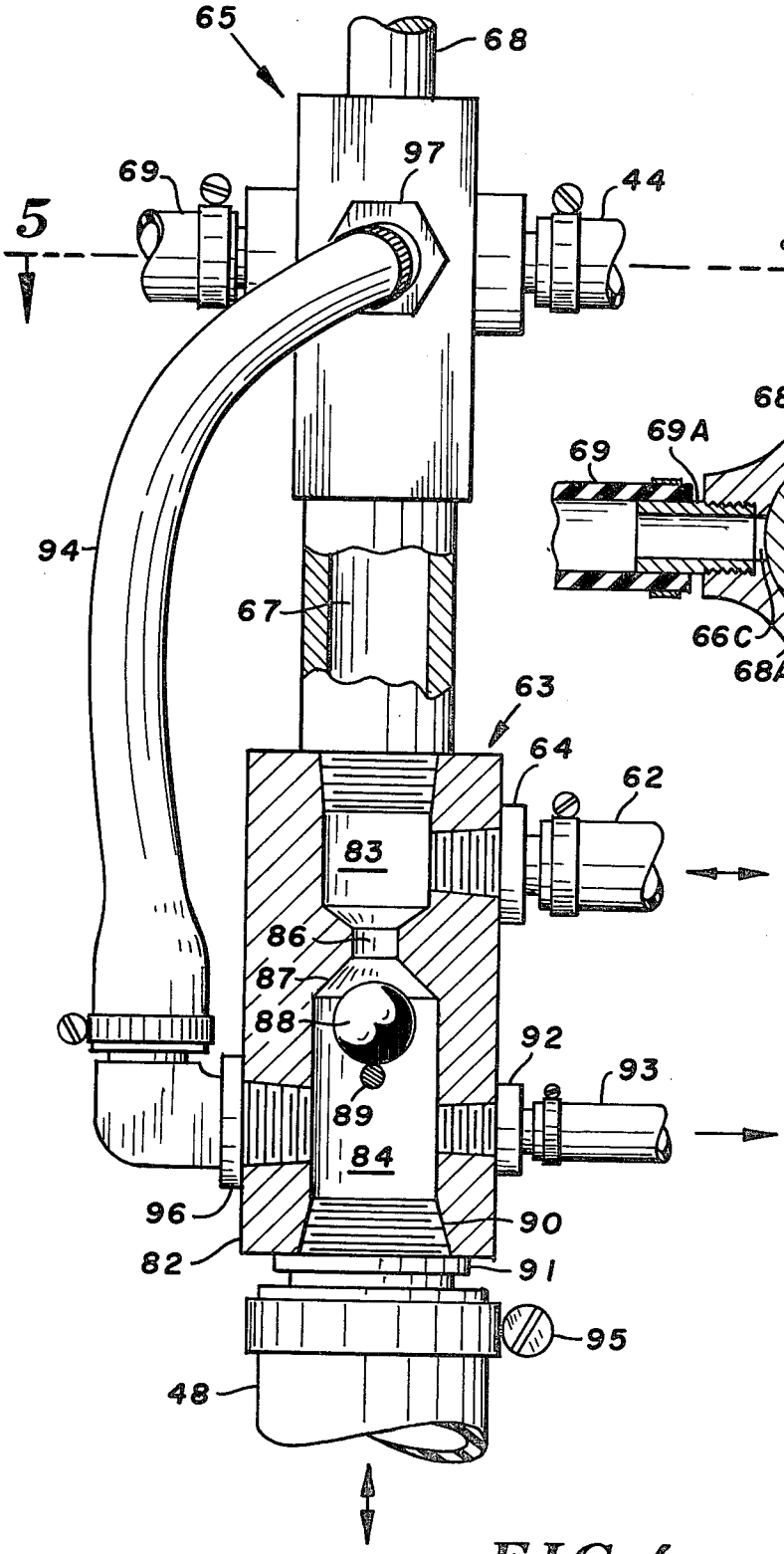
FIG. 4 is an enlarged elevational view, partly sectioned, of the fluid control valve and manifold of the apparatus of FIG. 1.

Referring to FIG. 4, there is shown an enlarged elevational view of control valve 65 and manifold 63. Manifold 63 has an upright body 82 provided with a first chamber 83 and a second chamber 84. A restricted passage 86 in the center portion of body 82 connects chambers 83 and 84. Body 82 has an annular tapered shoulder or seat 87 facing chamber 84 and leading to passage 86. A check ball or valving member 88 is located adjacent shoulder 87. Ball 88 has a diameter larger than passage 86 whereby ball 88 will close passage 86 when it engages should 87. A pin 89 projected into chamber 84 below balls 88 retains the ball in operative position relative to seat 87. The lower end of body 82 has a threaded opening 90 accommodating a coupling 91. Inlet hose 48 is clamped onto coupling 91 with a suitable clamp 95. A second coupling 92 threaded into a hole in the side of body 82 is open to second chamber 84. A hose 93 mounted on coupling 92 leads to pressure gauage 52 operable to monitor the liquid pressure in the cooling system. A liquid by-pass hole 94 extends between a coupling 96 threaded into the lower portion of body 82 and open to second chamber 84 and a coupling 97 attached to control valve 65, as shown in FIG. 5. Hose 94 carries liquid from control valve 65 to second chamber 84.

Referring to FIGS. 7 and 8, pump assembly 53 comprises an upright tubular casing or cylinder 101 accommodating a body 102. Body 102, a circular member located within the center portion of cylinder 101, is attached thereto with a plurality of fasteners 103, as bolts. Body 102 has a radial bore 104 open to the inside of cylinder 101 and a short axial passage 106 open to bore 104 and a first air chamber 126 above body 102. A nipple 107 projected through a hole in cylinder 101 is threaded into bore 104. Nipple 107 has a small axial passage 108 open to bore 104 to restrict the flow of air under pressure into chamber 126. Passage 106 can have a smaller diameter to further restrict the rate of air flow into chamber 126. Nipple 107 can be replaced with another nipple having a larger or smaller passage 108 to provide the desired air flow to chamber 126. Other types of air regulators including regulator 58 can be used to control the flow of air into chamber 126.

The center of body 102 has an axial passage 109 accommodating a pair of seals or O-rings 111. An elongated tubular member or hollow rod 112 provided with a longitudinal passage 113 extends through passage 109 and is located in sliding sealing engagement with O-rings 111. Member 112 has radial outlet passages or openings 114 providing air communication between passage 113 and an air chamber 116. Cylinder 101 has an exhaust port 117 allowing air to flow from chamber 116 to the atmosphere and from the atmosphere into chamber 116.

A first cylindrical pump piston 118 is located in chamber 116. Piston 118 carries a pair of seals or O-rings 119. Seals 119 located in suitable annular grooves in the outer peripheral edge of piston 118 are in sliding sealing contact with the inner cylindrical surface 101. The bottom of cylinder 101 is closed with a cap or closure 121 forming a liquid chamber 122 between piston 118 and cap 121. The center of cap 121 carries connector 61 which provides a liquid passage from chamber 122 to pump hose 62.

A second or air drive piston 123 is connected to the upper end of member 112 whereby piston 123 moves concurrently with pump piston 118. The outer peripheral edge of piston 123 has a groove accommodating an annular seal or O-ring 124. Seal 124 is located in sliding sealing engagement with the inside wall of the upper end of cylinder 101. Additional seals similar to seal 124 can be mounted on piston 123. Drive piston 123 separates the upper section of cylinder 101 into a first air chamber 126 and a second air chamber 127. A cap or cover 128 mounted on top of cylinder 101 closes the top of chamber 127. A coiled spring 129 secured to the bottom of cover 128 provides a cushion for drive piston 123.

Referring to FIGS. 7 and 8, drive piston 123 has a central passage 131 aligned with passage 113 in tubular member 112. The air from chamber 127 can flow through passage 131 and 113, through holes 114, chamber 116, and port 117 to the atmosphere. Three circumferentially spaced holes 132 extend through piston 123 providing air passages between first chamber 126 and second chamber 127.

A shuttle valve mechanism 130 mounted on piston 123 operates to control the flow of air into and out of chamber 127. Valve mechanism 130 has a generally flat valving ring 133 located below piston 123. Ring 133 has three upwardly directed bosses 134 aligned with holes 132. O-rings or seals 136 surround each boss 134. Seals 136 are adapted to engage the bottom surface of piston 123 to close holes 132. A circular plate 137 is located over the top of piston 123. Bolts 138 extended through holes 132 are connected to ring 133 and plate 137. Bolts 138 surround sleeves 139 which serve as spacers for maintaining an axial distance between ring 133 and plate 137 greater than the thickness of piston 123. Plate 137 has a central downwardly extended boss 141 aligned with passage 131. An O-ring or seal 142 surrounds boss 141. Seal 142 is adapted to engage an annular portion of the top of piston 123 surrounding passage 131 to close passage 131.

A flat annular washer 143 surrounds member 112 below ring 133. A coil spring 144 separates washer 143 from the top of body 102. Washer 143 serves as a cushion stop for ring 133 during the operation of pump assembly 53.

Figure 9:
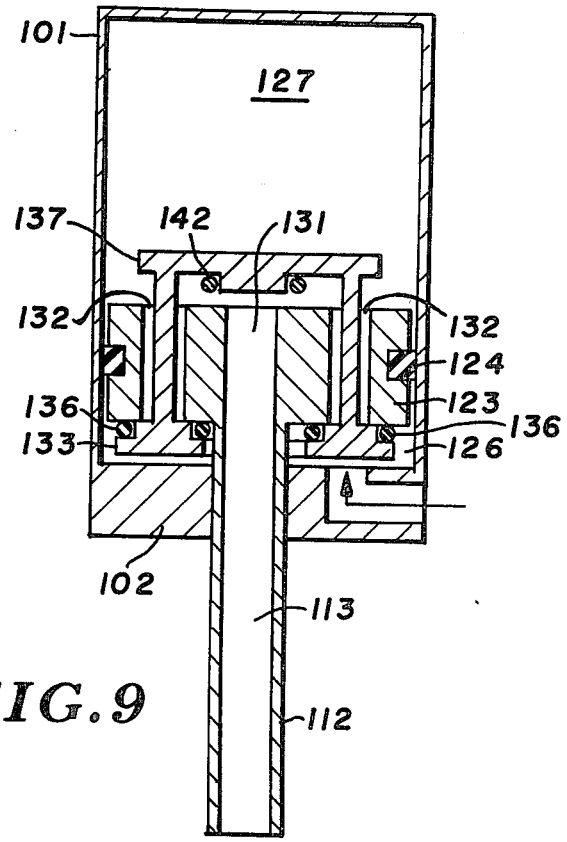
FIGS. 9–12 are diagrammatic views of the up stroke and down stroke operating positions of the air drive piston and reverse shuttle valving means associated with the drive piston.
Figure 10:
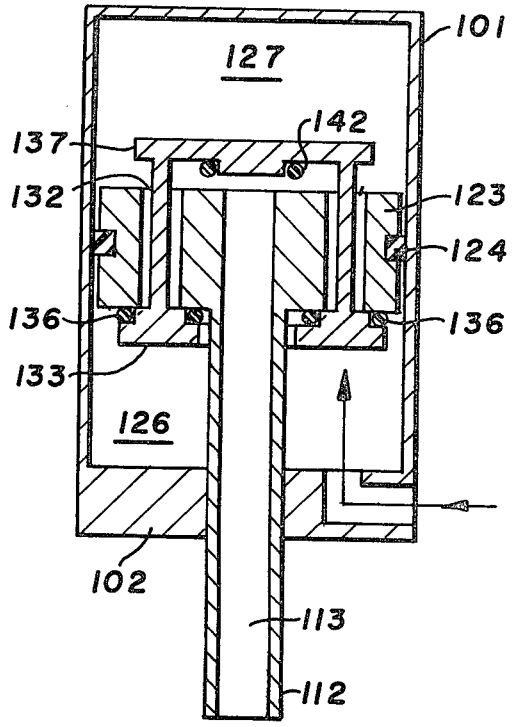

FIGS. 9–12 diagrammatically show the operation of air piston 123 and its associated shuttle valving mechanism 130 as air under pressure reciprocating piston 123 in cylinder 101. Referring to FIG. 9, a piston 123 is located in its lower or bottom position adjacent body 102. Air under pressure introduced into first chamber 126 drives piston 123 in an upward direction. The air in second chamber 127 flows through passage 131 in piston 123 and passage 113 in tubular member 112 to the atmosphere via holes 114, chamber 116, and port 117, as shown in FIG. 7. FIG. 10 shows piston 123 with the valve ring 133 in its closed position moving in an upward direction.

Figure 11:
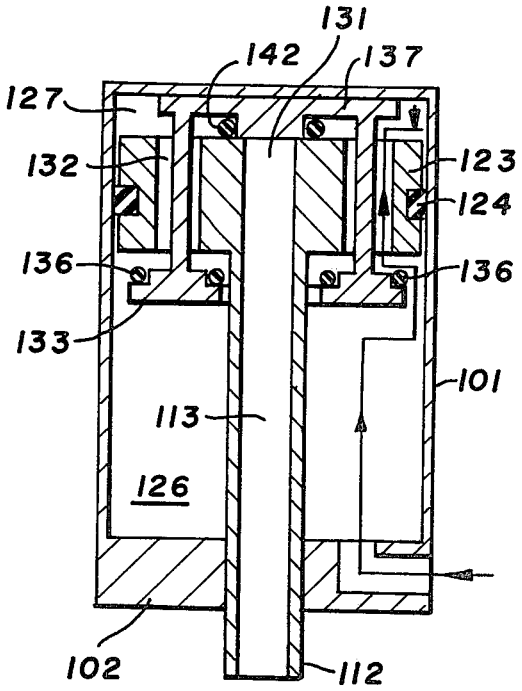
Figure 12:
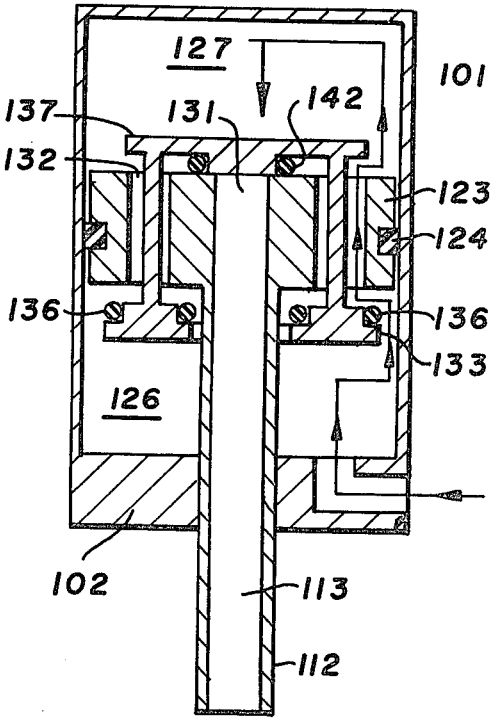

FIG. 11 shows shuttle valve assembly 130 with the ring 136 in the open position opening holes 132 and closing passage 131. The air flows through chamber 126, passages 132, and into chamber 127. As shown in FIG. 12, the air pressure in chamber 127 drives piston 123 in a downward direction. Piston 123 continues to move in a downward direction until shuttle valve mechanism 130 moves back to its initial position, as shown in FIG. 9. Returning to FIG. 7, downward movement of piston 123 carries ring 133 into engagement with washer 143. Washer 143 resting on spring 144 will bias ring 133 into sealing engagement with the bottom of piston 123. This cuts off the air supply to the second chamber 124. Plate 137 being spaced from the top of piston 123 opens passage 133. The air under pressure in second chamber 127 is vented to the atmosphere via the passages 131, 113, hole 114, chamber 116, and port 117. Piston 123 will then move in an upward direction.

Piston 123 will continue to reciprocate in cylinder 101 as long as the air under pressure is supplied to first chamber 126. The speed of piston 123 is controlled by the air pressure and the volume of air allowed to flow into first chamber 126. Nipple 107 is provided with an air restricted passage 108 to control the rate of flow of air into the chamber 126. Nipple 107 can be replaced with another nipple having a larger passage 108 to increase the operating cycle of the drive piston 123. Other types of air flow controls, as regulator 52, can be used to regulate the speed of operation of piston 123.

Returning to FIG. 3, pump hose 62 is connected to reservoir hose 69 with a by-pass hose 168. A first tee 169 interposed in hose 62 is connected to one end of hose 168. A second tee 171 interposed in hose 69 is connected to the opposite or upper end of hose 168. A fluid restricting valve or needle valve 172 is carried by hose 168. Valve 172 has an adjusting control member 173 operable to adjustably restrict the flow of liquid through hose 168. Valve 172 can be mounted on the side wall of housing 33 thereby making control member 173 accessible from the outside of the apparatus. When control lever 51 is in the agitate mode, liquid in reservoir 41 can be pumped into pump hose 62 in a restricted amount determined by the adjustment of needle valve 172. Pump assembly 53 operates to progressively move the liquid in the hose 62 and the cooling system in a forward direction as the liquid surges or moves back and forth through the cooling system. The amount of forward movement of the liquid is determined by the amount of liquid that flows through the needle valve 172 into the pumping circuit. Needle valve 172 can be closed so that liquid in the reservoir 41 is not added to the system during the agitate mode.

Returning to FIG. 1, a liquid discharge on-off valve indicated generally at 176 is connected to a tee 177 located in the upper radiator hose 26. Valve 176 carries a discharge hose 178 for directing overflow liquid from the cooling system to a desired disposal container or location. Valve 176 has an adjustable control member 179 that is manually operable to turn the valve on and off.

Returning to FIG. 6, an anti-rust and water lubricant dispenser indicated generally at 181 is operatively associated with check valve 70 attached to the bottom of reservoir 41. Dispenser 181 has an elongated flexible hose or tube 182 carrying a sleeve connector 183. Connector 183 is threaded into a bore in the side of check valve 70. A passage 184 extends through the check valve and is open to the bore and valve passage 74. Passage 184 has a relatively small diameter which is open to passage 74 above shoulder 76 so that the liquid moving through passage 76 will draw liquid through small passage 184. The lower end of hose 182 extends down into a bottle or container 186 storing the liquid anti-rust inhibitor and water pump lubricant. The top of container 186 is closed with a cap 187. A control valve 188 mounted on cap 187 is adjustable to control the amount of flow of liquid through the hose 182. Valve 188 can be turned off to block the flow of the liquid in hose 182. Valve 188 can be mounted on the side wall of housing 133 so that its control would be accessible from the outside of the apparatus to regulate the flow of liquid in hose 182.

Figure 13:
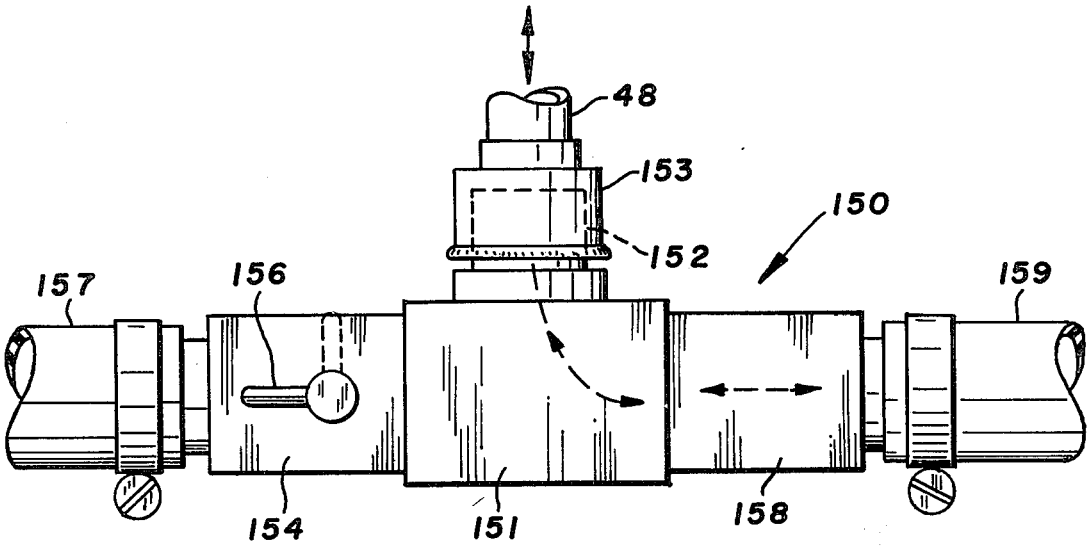
FIG. 13 is a side view of an on-off valve tee coupling for controlling the flow of liquid to the heater core.

Referring to FIG. 13, there is shown a first modification of the tee used to connect inlet hose 48 to the vehicle cooling system. The tee indicated generally at 150 has an on-off valve operable to block the flow of cleaning liquid to the engine block or water pump. Tee 150 has a body 151 carrying the upwardly directed inlet nipple 152. A releasable annular connector 153 is attached to nipple 152 to connect hose 48 to nipple 152. Connector 153 can be a threaded sleeve that is threaded onto nipple 152. Other types of connectors can be used to join hose 48 to nipple 152.

Body 151 has a first outlet member 154 carrying the on-off valve 156. On-off valve 156 can have a cylindrical member located in the passage of outlet member 154 for allowing liquid to flow through member 154 or blocking the flow of liquid through member 154. Hose 157 leading to the block or water pump of the engine is connected to member 154 with a suitable clamp. Body 151 also carries a second outlet member 158 accommodating heater inlet hose 159. When valve 156 is closed all of the cleaning liquid delivered by hose 48 to tee 150 is directed to heater hose 159 and carried thereby to the heater core and engine block, as diagrammatically shown in FIG. 1. A second on-off valve can be incorporated in member 158 whereby all the liquid flows to engine block via hose 157 when the valve is closed.

Figure 14:
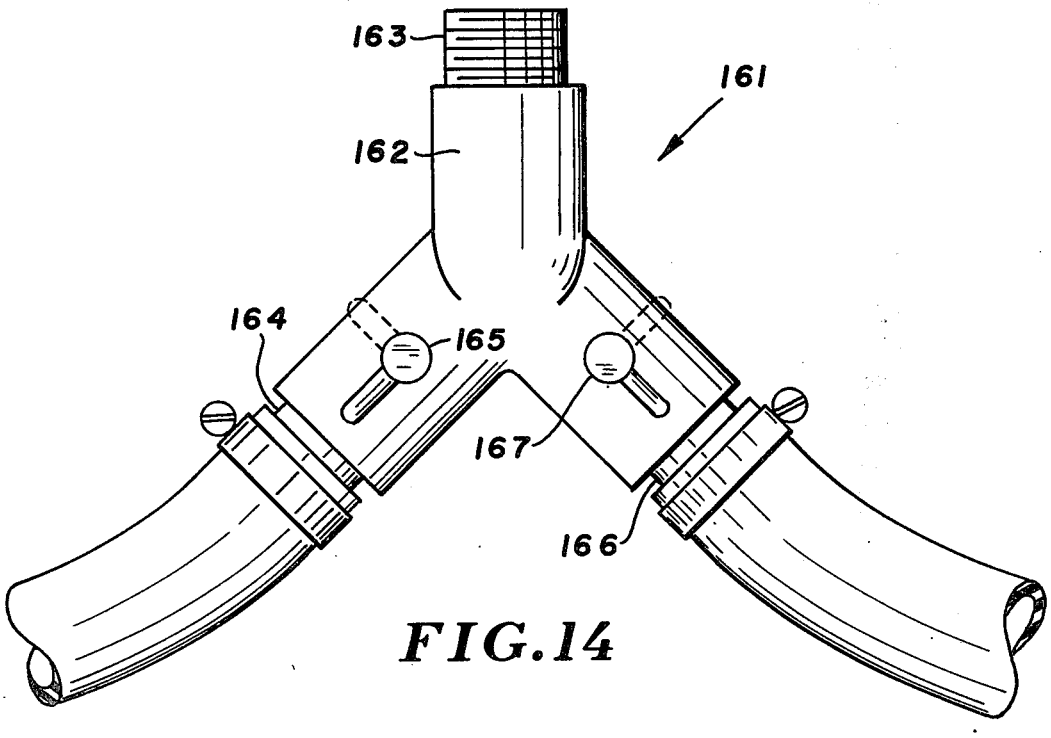
FIG. 14 is a modification of the on-off valve coupling of FIG. 13.

Referring to FIG. 14, there is shown another modification of the connector for coupling the output hose 48 to the cooling system of the internal combustion engine. Connector 161 is a Y-connector having a generally Y-shaped body 162. Body 162 has an inlet section or nipple 163 adapted to accommodate the connector attached to hose 48. Body 161 also has a pair of divergent outlet sections or nipples 164 and 166 adapted to be connected to the heater hose and hose leading to the engine block or water pump with suitable clamps. Outlet nipple 164 has an on-off valve 165 operable to control the flow of liquid through nipple 164. A similar on-off valve 167 is located in outlet nipple 166. Valves 165 and 167 are selectively operable whereby the operator of apparatus 20 can direct the flow of cleaning fluid directly and solely to the heater coil, solely to the engine block, or with both valves 165 and 167 open to both the heater coil and engine block.

The procedure for cleaning the cooling system of an internal combustion engine is as follows. The input hose 48 is initially connected to tee 49 with connector 50. The external water hose 44 is connected to a hose or water source, such as the well or city water system. The operator then removes the radiator can from radiator 23 and turns the control lever 51 to flush. This connects water hose 44 to manifold 63 filling the system with water. The valving cylinder 68 is turned to a position that its port 68A is aligned with the port 66A, thereby the external water flows through valve 65 into manifold 63. Input hose 48 carries the water from the manifold 63 to the inlet heater hose 29. When the cooling system is full of liquid, the control lever 51 is turned to the off position.

A radiator cleaning compound is then added to the open top of the radiator. The engine is run for about 5 minutes to circulate and warm the liquid coolant in the cooling system of the engine and mix the cleaning compound with the liquid or the cooling system.

Control lever 51 is then turned to agitate and the air line 46 is connected to connector 47. The air supplied to air line 57 operates pump assembly 53. Pump assembly 53 moves the liquid in forward and reverse directions providing a reversing surging action so that the moving fluid scrubs all of the internal surfaces of the cooling system. The agitate cycle is maintained for 10 to 30 minutes or more in order to insure a maximum cleaning effectiveness.

Control lever 51 is then turned back to the flush position whereby external water from hose 44 is directed under pressure into input hose 48. The discharge valve 176 is turned to the open position so that the liquid in the upper radiator hose 26 will be discharged through drain hose 178. The radiator cap is placed back on top of the radiator 23 in its operative position so that all of the liquid in the cooling system flows through the discharge valve 176. The flushing of the radiator is continued until the discharge liquid from hose 178 is clear. An air line 46 can be connected to the apparatus 20 so that the pump assembly 53 will continue to operate during the flushing of the cooling system. The pump apparatus 53 will provide a pulsating or cyclic surging effect on the liquid as it is flushed through the cooling system. This enhances the flushing of the foreign matter from the cooling system.

Control lever 51 is again turned to the off position as soon as the liquid discharge from the hose 178 is clear. Valve 176 is turned to the off position. The apparatus of cooling system is now in condition for checking for leaks and weak portions of the hoses. Control lever 51 is turned back to the flush position, thereby connecting the external water hose 44 to manifold 63. The liquid in hose 44 being under pressure subjects the liquid in the cooling system to a pressure. This pressure is from 15 to 22 psi depending on the pressure release parameters of the radiator cap. As soon as the desired pressure in the cooling system is reached, the control lever 51 is turned to the off position. The static pressure in the cooling system is indicated by the pressure gauge 52. The pressure gauge 52 is provided with an adjustable reference line (not shown), which is set at the indicated static pressure of the liquid in the cooling system. If the pressure in the cooling system falls off, the cooling system is checked for leaks. After the appropriate repairs to the hoses or radiator cap are made, the pressure of the cooling system is again subjected to the desired pressure to insure that there are no further leaks.

Apparatus 20 is now ready to be placed in the fill mode. A desired amount of anti-freeze or other coolant is placed in reservoir 41. The amount of anti-freeze placed in reservoir 41 is dependent on the liquid holding capacity of the cooling system. Discharge valve 176 is turned to the open position. Control lever 51 is turned to the fill position. Referring to FIG. 5, when control lever 15 is turned to the fill position, cylinder 68 is turned to a position so that its port 68A is aligned with the fill port 66C. Pump assembly 53 is then operated to pump the liquid coolant from reservoir 41 into the input hose 48 connected to the heater hose 29. Pump assembly 53 continues to operate until all of the liquid in reservoir 41 is pumped into the cooling system. Filter unit 42 located in reservoir chamber 43 filters all of the coolant that is pumped from reservoir 41 into the cooling system. Check valve balls 88 and 77 sequentially open and close during the pumping of the liquid from reservoir 41. When pump piston moves down or in the pressure stroke, valve 77 will move up to the closed position. Ball 88 will move downwardly or to its open position allowing the liquid to flow to hose 69 through manifold 63 into the input hose 48. When pump piston 118 moves in the up or suction stroke, ball 88 moves to the closed position. Ball 77 moves to the open position whereby liquid in reservoir chamber 43 is drawn through filter unit 42 into reservoir hose 69.

A controlled amount of anti-rust and water pump lubricant automatically is drawn and mixed into the anti-freeze flowing through check valve 70. Dispenser 181 operates to allow a controlled amount of anti-rust and water pump lubricant to flow through its feeding hose 182. Valve 188 is adjusted to control the flow of liquid through hose 182 and into the passage 74 of check valve 70.

While there has been shown and described one embodiment of the apparatus for cleaning, flushing, and filling a cooling system of an internal combustion engine, it is understood that changes in the structures and components can be made by those skilled in the art without departing from the invention. The invention is defined in the following Claims.

The embodiments of the invention in which an exclusive property or privilege is claimed are defined as follows:

1. An apparatus for cleaning, flushing, and filling a liquid cooling system of an internal combustion engine, said cooling system including an engine block and radiator for accommodating cooling liquid, and means for carrying liquid connected to the block comprising: a portable housing adapted to be moved to a desired location, said housing having a top wall, a pump assembly mounted on the housing below the top wall, said pump assembly having a cylinder and a pump piston located within the cylinder, drive means connected to the pump piston to reciprocate the pump piston in the cylinder, said drive means being operated in response to air under pressure; a manifold having a first chamber, a second chamber, and a one-way valve allowing liquid to flow in a forward direction from the first chamber to the second chamber, a pump hose connected to the pump assembly and manifold for carrying liquid from the pump assembly to the first chamber of the manifold, an input hose connected to the manifold for receiving liquid from the second chamber and adapted to be connected to the means for carrying liquid connected to the block, a control valve mounted on the top wall connected to the manifold in liquid communication with the first chamber, said control valve having a valving means movable to a flush position, an agitate position, a fill position, and an off position, means for carrying water under pressure to the control valve, said valving means when in the flush position being operable to direct said water under pressure to the manifold, thereby providing water under pressure to the cooling system, a by-pass hose connected to the control valve and manifold in liquid communication with the second chamber, said valving means when in the agitate position connecting the by-pass hose to the first chamber of the manifold whereby reverse flow of liquid moves from the second chamber through by-pass hose, control valve, and first chamber to the pump hose so that the reciprocating pump piston causes sequential movement of the liquid in forward and reverse directions in the liquid cooling system of the internal combustion engine.

2. The apparatus of claim 1 including: a reservoir having a chamber for accommodating a reservoir liquid mounted on the top wall, outlet means associated with the reservoir for carrying reservoir liquid to the control valve, and one-way valve means allowing reservoir liquid to flow from the reservoir to the control valve, said valving means when in the fill position being operable to direct the reservoir liquid from the reservoir to the manifold whereby said pump assembly pumps the reservoir liquid into the cooling system.

3. The apparatus of claim 2 including: filter means located in the chamber for filtering the reservoir liquid before the reservoir liquid is delivered to the outlet means.

4. The apparatus of claim 2 wherein: the reservoir has a bottom wall; said outlet means including a connector having a passage open to the chamber, and a reservoir hose joined to said connector and said control valve; said one-way valve means comprising a ball positioned in said passage for blocking the reverse flow of reservoir liquid from the reservoir hose to the reservoir chamber.

5. The apparatus of claim 4 including: a liquid filtering unit having a sleeve, said connector having a nipple projected into the reservoir chamber adapted to be releasably connected to said sleeve whereby the filtering unit is mounted so it can be removed from the reservoir.

6. The apparatus of claim 2 including: dispenser means cooperating with the outlet means to discharge a second liquid into the reservoir liquid as the reservoir liquid flows through the outlet means.

7. The apparatus of claim 6 wherein: the dispenser means includes a container for storing the second liquid, a line for carrying the second liquid from the container to the outlet means, means to restrict the flow of the second liquid in said line, and means to connect the line to the outlet means.

8. The apparatus of claim 7 wherein: the means to restrict the flow of the second liquid includes an adjustable valve.

9. The apparatus of claim 1 including: a reservoir having a chamber for accommodating a reservoir liquid, outlet means for carrying liquid to the control valve, one-way valve means allowing the reservoir liquid to flow from the reservoir to the control valve, and means for carrying reservoir liquid directly to the pump hose, said means for carrying reservoir liquid having means to restrict the flow of reservoir liquid to the pump hose.

10. The apparatus of claim 9 wherein: the means to restrict the flow of reservoir liquid includes an adjustable valve.

11. The apparatus of claim 1 including: liquid pressure gauge means mounted on the top wall, and hose means connecting the gauge means to the manifold in liquid communication with the second chamber.

12. The apparatus of claim 1 wherein: the drive means includes a drive piston located in the cylinder, means connecting the drive piston with the pump piston, a shuttle valve mechanism mounted on the drive piston for controlling the flow of air under pressure from the first to the second side of the drive piston whereby air under pressure directed into the cylinder adjacent the first side of the drive piston operates to reciprocate the drive piston in the cylinder.

13. The apparatus of claim 1 wherein: the cooling system includes a heater and a liquid inlet hose connected to the heater and engine block, a connector attached to the inlet hose and output hose directing liquid to the heater and engine block.

14. The apparatus of claim 13 including: on-off valve means associated with the connector operable to block the flow of liquid to the engine block whereby all the liquid flows to the heater.

15. The apparatus of claim 13 including: on-off valve means associated with the connector operable to block the flow of liquid to the heater whereby all the liquid flows to the engine block.

16. The apparatus of claim 13 including: first on-off valve means associated with the connector operable to block the flow of liquid to the engine block whereby all the liquid flows to the heater, and second on-off valve means associated with the connector operable to block the flow of liquid to the heater whereby all the liquid flows to the engine block when the first valve means is open.

17. An apparatus for cleaning, flushing, and filling a liquid cooling system of an internal combustion engine, said cooling system including an engine block and radiator for accommodating cooling liquid, and means for carrying liquid connected to the block comprising: a control valve having valving means movable to an off position, a fill position, an agitate position and a flush position, first means for carrying liquid under pressure to the control valve, second means for carrying liquid from the control valve to the means for carrying liquid connected to the block, said liquid flowing from the first means to the second means when the valving means is in the flush position, pump means connected to the second means for moving liquid in the second means and liquid cooling system, said pump means including a cylinder and a pump piston located in the cylinder operable to move liquid in the cooling system when the valving means is in the agitate position, a reservoir having a chamber for holding a reservoir liquid, outlet means connecting the reservoir to the control valve, said pump means operable to pump reservoir liquid from the reservoir to the second means when the valving means is in the fill position, drive means connected to the pump piston to reciprocate the piston in the cylinder, said drive means being operable in response to air under pressure, said second means including a manifold and an input hose connected to the manifold and means for carrying liquid connected to the block, means for carrying liquid from said pump means to the manifold, a one-way valve associated with the manifold for controlling the flow of liquid through the manifold, and a passage means by-passing the one-way valve whereby the pump means operates to sequentially move the liquid in forward and reverse directions in the cooling system.

18. The apparatus of claim 17 wherein: the drive means includes a drive piston located in the cylinder, means connecting the drive piston with the pump piston, a shuttle valve mechanism mounted on the drive piston for controlling the flow of air under pressure from the first to the second side of the drive piston whereby air under pressure directed into the cylinder adjacent the first side of the drive piston operates to reciprocate the drive piston in the cylinder.

19. The apparatus of claim 17 including: dispenser means cooperating with the outlet means to discharge a second liquid into the reservoir liquid as the reservoir liquid flows through the outlet means.

20. The apparatus of claim 19 wherein: the dispenser means includes a container for storing the second liquid, a line for carrying the second liquid from the container to the outlet means, means to restrict the flow of the second liquid in said line, and means to connect the line to the outlet means.

21. The apparatus of claim 20 wherein: the means to restrict the flow of the second liquid includes an adjustable valve.

22. The apparatus of claim 17 including: one-way valve means allowing liquid to flow from the reservoir to the outlet means.

23. The apparatus of claim 22 including: a liquid filtering unit located in the reservoir for filtering the liquid flowing into the outlet means.

24. The apparatus of claim 17 wherein: the means for carrying liquid includes a heater core and a heater inlet hose, said second means being connected to the heater inlet hose.

25. The apparatus of claim 17 including: a liquid filtering unit located in the reservoir for filtering the liquid moving from the reservoir to the outlet means.

26. The apparatus of claim 17 wherein: the reservoir has a bottom wall, said outlet means including a connector mounted on said bottom wall, said connector having a passage open to the chamber and a nipple projected into the chamber, a liquid filtering unit located in the chamber for filtering the liquid flowing into the outlet means, said filter unit having means for mounting the filtering unit on the nipple.

27. The apparatus of claim 26 wherein: the filtering unit is a conventional oil filtering cartridge.

28. The apparatus of claim 26 including: one-way valving means located in the passage of the connector allowing liquid to flow from the chamber to the outlet means.

29. The apparatus of claim 17 including: liquid filtering means located in the chamber for filtering the liquid flowing into the outlet means, and means mounting the filtering means on the reservoir.

30. The apparatus of claim 29 wherein: the liquid filtering means is a conventional oil filtering cartridge.

31. An apparatus for cleaning, flushing, and filling a liquid accommodating system of an apparatus and means for carrying liquid connected to the apparatus comprising: a housing, a pump assembly mounted on the housing, said pump assembly having a cylinder and a pump piston located within the cylinder, drive means connected to the pump piston to reciprocate the pump piston in the cylinder, said drive means being operated in response to air under pressure; a manifold having a first chamber, a second chamber, and a one-way valve allowing liquid to flow in a forward direction from the first chamber to the second chamber, first means connected to the pump assembly and manifold for carrying liquid from the pump assembly to the first chamber of the manifold, second means connected to the manifold for receiving liquid from the second chamber and adapted to be connected to the means for carrying liquid connected to the apparatus, a control valve connected to the manifold in liquid communication with the first chamber, said control valve having valving means movable to a flush position, an agitate position, a fill position, and an off position, means for carrying water under pressure to the control valve, said valving means when in the flush position being operable to direct said water under pressure to the manifold thereby providing water under pressure to the liquid accommodating system, liquid by-pass means connected to the control valve and manifold in liquid communication with the second chamber, said valving means when in the agitate position connecting the by-pass means to the first chamber of the manifold whereby reverse flow of liquid moves from the second chamber through by-pass means, control valve, and first chamber to the first means so that the reciprocating pump piston causes sequential movement of the liquid in forward and reverse directions in the liquid accommodating system.

32. The apparatus of claim 31 including: a reservoir having a chamber for accommodating a reservoir liquid, outlet means associated with the reservoir for carrying reservoir liquid to the control valve, and one-way valve means allowing reservoir liquid to flow from the reservoir to the control valve, said valving means when in the fill position being operable to direct the reservoir liquid from the reservoir to the manifold whereby said pump assembly pumps the reservoir liquid into the liquid accommodating system.

33. The apparatus of claim 32 including: filter means located in the chamber for filtering the reservoir liquid before the reservoir liquid is delivered to the outlet means.

34. The apparatus of claim 32 wherein: the reservoir has a bottom wall; said outlet means including a connector having a passage open to the chamber, and a reservoir hose joined to said connector and said control valve; said one-way valve means comprising a ball positioned in said passage for blocking the reverse flow of reservoir liquid from the reservoir hose to the reservoir chamber.

35. The apparatus of claim 34 including: liquid filtering means having a sleeve, said connector having a nipple projected into the reservoir chamber adapted to be releasably connected to said sleeve whereby the filtering means is mounted so it can be removed from the reservoir.

36. The apparatus of claim 35 wherein: the liquid filtering means is a conventional oil filtering cartridge.

37. The apparatus of claim 32 including: dispenser means cooperating with the outlet means to discharge a second liquid into the reservoir liquid as the reservoir liquid flows through the outlet means.

38. The apparatus of claim 37 wherein: the dispenser means includes a container for storing the second liquid, a line for carrying the second liquid from the container to the outlet means, means to restrict the flow of the second liquid in said line, and means to connect the line to the outlet means.

39. The apparatus of claim 38 wherein: the means to restrict the flow of the second liquid includes an adjustable valve.

40. The apparatus of claim 31 including: a reservoir having a chamber for accommodating a reservoir liquid, outlet means for carrying liquid to the control valve, one-way valve means allowing the reservoir liquid to flow from the reservoir to the control valve, and means for carrying reservoir liquid directly to the first means, said means for carrying reservoir liquid having means to restrict the flow of reservoir liquid to the first means.

41. The apparatus of claim 40 wherein: the means to restrict the flow of reservoir liquid includes an adjustable valve.

42. The apparatus of claim 31 including: liquid pressure gauge means operable to sense the pressure of the liquid in the second chamber of the manifold.

43. The apparatus of claim 31 wherein: the drive means includes a drive piston located in the cylinder, means connecting the drive piston with the pump piston, a shuttle valve mechanism mounted on the drive piston for controlling the flow of air under pressure from the first to the second side of the drive piston whereby air under pressure directed into the cylinder adajacent the first side of the drive piston operates to reciprocate the drive piston in the cylinder.

44. An apparatus for cleaning, flushing, and filling a liquid accommodating system of an apparatus and means for carrying liquid connected to the apparatus comprising: a pump means having reciprocating means for pumping liquid, drive means for operating the pump means, a manifold having a first chamber and a second chamber, and a one-way valve allowing liquid to flow in a forward direction from the first chamber to the second chamber, first means connected to the pump means and manifold for carrying liquid from the pump means to the first chamber of the manifold, second means connected to the manifold for receiving liquid from the second chamber and adapted to be connected to the means for carrying liquid connected to the apparatus, a control valve connected to the manifold in liquid communication with the first chamber, said control valve having valving means movable to a flush position, agitate position, a fill position, and an off position, means for carrying water under pressure to the control valve, said valving means when in the flush position being operable to direct said water under pressure to the manifold thereby providing water under pressure to the liquid accommodating system, liquid by-pass means connected to the control valve and manifold in liquid communication with the second chamber, said valving means when in the agitate position connecting the by-pass means to the first chamber of the manifold whereby reverse flow of liquid moves from the second chamber through by-pass means, control valve, and the first chamber to the first means so that the pump means causes sequential movement of the liquid in forward and reverse directions in the liquid accommodating system.

45. The apparatus of claim 44 including: a reservoir having a chamber for accommodating a reservoir liquid, outlet means associated with the reservoir for carrying reservoir liquid to the control valve, and one-way valve means allowing reservoir liquid to flow from the reservoir to the control valve, said valving means when in the fill position being operable to direct the reservoir liquid from the reservoir to the manifold whereby said pump means pumps the reservoir liquid into the liquid accommodating system.

46. The apparatus of claim 45 including: filter means located in the chamber for filtering the reservoir liquid before the reservoir liquid is delivered to the outlet means.

47. The apparatus of claim 45 wherein: the reservoir has a bottom wall; said outlet means including a connector having a passage open to the chamber, and a reservoir hose joined to said connector and said control valve; said one-way valve means comprising a ball positioned in said passage for blocking the reverse flow of reservoir liquid from the reservoir hose to the reservoir chamber.

48. The apparatus of claim 47 including: liquid filtering means having a sleeve, said connector having a nipple projected into the reservoir chamber adapted to be releasably connected to said sleeve whereby the filtering means is mounted so it can be removed from the reservoir.

49. The apparatus of claim 48 wherein: the liquid filtering means is a conventional oil filtering cartridge.

50. The apparatus of claim 45 including: dispenser means cooperating with the outlet means to discharge a second liquid into the reservoir liquid as the reservoir liquid flows through the outlet means.

51. The apparatus of claim 50 wherein: the dispenser means includes a container for storing the second liquid, a line for carrying the second liquid from the container to the outlet means, means to restrict the flow of the second liquid in said line, and means to connect the line to the outlet means.

52. The apparatus of claim 51 wherein: the means to restrict the flow of the second liquid includes an adjustable valve.

53. The apparatus of claim 44 including: a reservoir having a chamber for accommodating a reservoir liquid, outlet means for carrying liquid to the control valve, one-way valve means allowing the reservoir liquid to flow from the reservoir to the control valve, and means for carrying reservoir liquid directly to the first means, said means for carrying reservoir liquid having means to restrict the flow of reservoir liquid to the first means.

54. The apparatus of claim 53 wherein: the means to restrict the flow of reservoir liquid includes an adjustable valve.

55. The apparatus of claim 44 including: liquid pressure gauge means operable to sense the pressure of the liquid in the second chamber of the manifold.

56. The apparatus of claim 44 wherein: said pump means includes a reciprocating piston, said drive means includes a cylinder and a drive piston located in the cylinder, means connecting the drive piston with the pump piston, a shuttle valve mechanism mounted on the drive piston for controlling the flow of air under pressure from the first to the second side of the drive piston whereby air under pressure directed into the cylinder adjacent the first side of the drive piston operates to reciprocate the drive piston in the cylinder.

* * * * *

UNITED STATES PATENT AND TRADEMARK OFFICE

CERTIFICATE OF CORRECTION

PATENT NO. : 4,276,914

DATED : July 7, 1981

INVENTOR(S) : Robert V. Albertson

It is certified that error appears in the above-identified patent and that said Letters Patent are hereby corrected as shown below:

Column 3, line 55, "or" first occurrence should be --to--.

Column 8, line 56, "can" should be --cap--.

Signed and Sealed this

Sixth Day of October 1981

[SEAL]

*Attest:*

GERALD J. MOSSINGHOFF

*Attesting Officer*

*Commissioner of Patents and Trademarks*